US006965293B2

(12) United States Patent
Choi et al.

(10) Patent No.: US 6,965,293 B2
(45) Date of Patent: Nov. 15, 2005

(54) ELECTRICAL DEVICE HAVING PTC CONDUCTIVE POLYMER

(75) Inventors: Soo-An Choi, Kyunggi-do (KR); Jong-Ho Lee, Kyunggi-do (KR); Chang-Hee Choi, Seoul (KR); Tae-Sung Kim, Seoul (KR); Jun-Ku Hahn, Seoul (KR)

(73) Assignee: LG Cable, Ltd., Seoul (KR)

( * ) Notice: Subject to any disclaimer, the term of this patent is extended or adjusted under 35 U.S.C. 154(b) by 0 days.

(21) Appl. No.: 10/877,188

(22) Filed: Jun. 24, 2004

(65) Prior Publication Data

US 2004/0233033 A1 Nov. 25, 2004

Related U.S. Application Data

(63) Continuation-in-part of application No. 10/239,091, filed as application No. PCT/KR01/00523 on Mar. 30, 2001, now abandoned.

(30) Foreign Application Priority Data

Apr. 8, 2000 (KR) ..... 10-2000-18453

(51) Int. Cl.[7] ..... H01C 7/10
(52) U.S. Cl. ..... 338/22 R; 338/22 SD
(58) Field of Search ..... 338/22 R, 22 SD

(56) References Cited

U.S. PATENT DOCUMENTS 4,426,633 A 1/1984 Taylor ..... 338/25
4,689,475 A 8/1987 Kleiner et al. ..... 219/553
4,800,253 A 1/1989 Kleiner et al. ..... 219/553
4,857,880 A 8/1989 Au et al. ..... 338/22
4,907,340 A 3/1990 Fang et al. ..... 29/610.1
5,874,885 A 2/1999 Chandler ..... 338/22
5,955,936 A * 9/1999 Shaw et al. ..... 338/22 R
6,157,289 A 12/2000 Kojima et al. ..... 338/22
6,188,308 B1 2/2001 Kojima et al. ..... 338/22
6,522,237 B1 * 2/2003 Ito et al. ..... 338/22 R
6,570,483 B1 * 5/2003 Chandler et al. ..... 338/22 R

FOREIGN PATENT DOCUMENTS

EP 0573945 B1 10/1997 ..... H01C/1/14
KR 2001-0090933 A 10/2001

* cited by examiner

*Primary Examiner*—Karl D. Easthom
(74) *Attorney, Agent, or Firm*—Jones Day

(57) ABSTRACT

An electrical device including a PTC conductive polymer sheet, and first and second electrodes physically contacted with opposite surfaces of the conductive polymer sheet is disclosed. The first and second electrodes have a plurality of protrusions protruded from surfaces thereof, respectively. The protrusions have an surface roughness (Rz) of 1 to 20 μm and an average width ($\overline{Rw}$) which is 0.5 to 2 times of the surface roughness (Rz), and an average gap ($\overline{Rg}$) between adjacent protrusions is 0.5 and 2 times of the surface roughness (Rz). The conductive polymer sheet has a thickness which is more than 5 times of the surface roughness (Rz).

6 Claims, 1 Drawing Sheet

ELECTRICAL DEVICE HAVING PTC CONDUCTIVE POLYMER

REFERENCE TO RELATED APPLICATIONS

This application is a continuation-in-part under 35 U.S.C 120 of U.S. application Ser. No. 10/239,091 filed on Sep. 19, 2002 now abandoned which is a 371 of PCT/KR01/00523 filed Mar. 30, 2001, and foreign priority benefit under 35 U.S.C. 119 of Korean Application No. 10-2000-18453 filed on Apr. 8, 2000.

BACKGROUND OF THE INVENTION

1. Field of the Invention

The present invention relates to an electrical device having a PTC (Positive Temperature Coefficient) conductive polymer, and more particularly to a PTC electrical device, which is light, thin, short and small with giving excellent binding force between a conductive polymer and an electrode and not causing a breakdown during being combined.

2. Description of the Related Art

Electrical devices having PTC conductive polymer are well known in the art. Conductive polymer contains organic polymer in which conductive fillers are dispersed, and shows PTC characteristic. PTC characteristic means a property that electrical resistance is abruptly increased in a narrow temperature region, and polymer materials having such PTC characteristic are generally applied to a self-regulating heating cable, a protection device for blocking over current, a circuit protection element, a heater and so on.

Such conductive polymer is mechanically and chemically combined with at least one electrode in an electrical device. A metal plate is generally used as the electrode. Examples of such devices are disclosed in U.S. Pat. No. 4,426,633 by Taylor, U.S. Pat. No. 4,689,475 by Matthiesen, U.S. Pat. No. 4,800,253 by Kleiner et al., U.S. Pat. No. 4,857,880 by Au et al., U.S. Pat. No. 4,907,340 by Fang et al, and U.S. Pat. No. 4,426,633 by Fang et al.

The binding force between the metal plate and the conductive polymer may be generally classified into mechanical binding force and chemical binding force. For improving the mechanical binding force, there is needed a process of increasing surface roughness of the metal plate in order to restrain separation of the metal plate and the conductive polymer.

U.S. Pat. No. 4,689,475 and U.S. Pat. No. 4,800,253 uses a metal plate having a microrough surface as an electrode in order to increase binding force with conductive polymer. In particular, U.S. Pat. No. 4,689,475 limits height and width of irregularities formed on the surface of the electrode to suitable sizes in order to increase the binding force with the conductive polymer. In addition, U.S. Pat. No. 4,800,253 uses a metal plate having a microrough surface including macronodules formed by a plurality of micronodules, as an electrode.

Meanwhile, U.S. Pat. No. 5,874,885 uses a metal plate having a base layer, an intermediate layer and a surface layer as an electrode which is to be contacted with the conductive polymer.

Recently, as electronic equipments become lighter, thinner, shorter and smaller, the size of PTC element is also more reduced. Thus, the thickness of the conductive polymer sheet interposed between electrodes is required to be smaller in order to reduce the size of PTC element. If the thickness of the conductive polymer sheet is decreased, protrusions such as nodules or irregularities formed on the surfaces of the opposite electrodes are approached or contacted, which is apt to cause a breakdown.

In addition, if nodules or irregularities are set to be too small as the thickness of the conductive polymer sheet is reduced, the mechanical binding force between electrode and conductive polymer is deteriorated.

Thus, it is required to suitably control height, width and gap of nodules or irregularities formed on the surface of the electrode as well as the thickness of a conductive polymer suitable for PTC element applied to light, thin, short and small electronic equipments.

However, any document mentioned above does not suggest optimal values of height, width and gap of the protrusions for causing no breakdown and ensuring easy and sufficient adhesion to a relatively thin conductive polymer without air gap.

SUMMARY OF THE INVENTION

The present invention is designed to solve the problems of the prior art, and therefore it is an object of the present invention to provide a roughness of an electrode surface which does not cause a breakdown problem and is capable of improving a mechanical binding force between electrode and conductive polymer having a relatively small thickness without air gap.

In order to accomplish the above object, the present invention provides an electrical device including a PTC (Positive Temperature Coefficient) conductive polymer sheet, and first and second electrodes physically contacted with opposite surfaces of the conductive polymer sheet.

The first and second electrodes have a plurality of protrusions protruded from surfaces thereof, respectively. The protrusions have an surface roughness (Rz) of 1 to 20 $\mu$m and an average width ($\overline{Rw}$) which is 0.5 to 2 times of the surface roughness (Rz), and an average gap ($\overline{Rg}$) between adjacent protrusions is 0.5 and 2 times of the surface roughness (Rz). In addition, the first and second electrodes respectively include a base layer made of a first metal having a microrough surface, and a surface layer made of a second metal and plated on the base layer with a uniform thickness. At this time, the second metal has relatively more excellent chemical binding force to the conductive polymer than the first metal. In addition, the conductive polymer sheet has a thickness which is more than 5 times of the surface roughness (Rz).

BRIEF DESCRIPTION OF THE DRAWINGS

Other objects and aspects of the present invention will become apparent from the following description of embodiments with reference to the accompanying drawing in which.

DESCRIPTION OF THE PREFERRED EMBODIMENT

Figure 1:
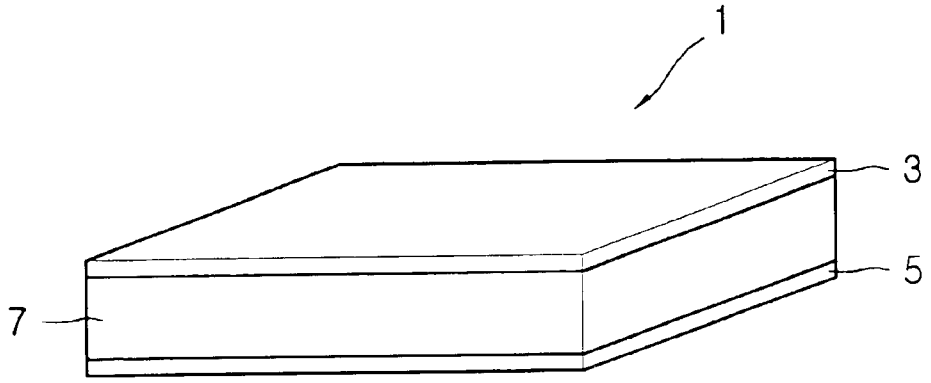
FIG. 1 is a perspective view showing a PTC electrical device according to a preferred embodiment of the present invention.

Hereinafter, the present invention will be described in more detail referring to the drawings.

As shown in FIG. 1, an electrical device 1 of the present invention includes a conductive polymer sheet 7 having PTC characteristics and metal electrodes 3 and 5 plated by a metal having good compatibility with the polymer. At this time, the conductive polymer 7 is preferably sandwiched between the metal electrodes 3 and 5 and then adhered thereto.

Conductive polymer composition for the polymer sheet 7 is obtained by mixing conductive filler, cross-linking agent, antioxidant and the like to organic polymer. At this time, the organic polymer may be selected from polyethylene, polypropylene or ethylene-acrylic acid copolymer, ethylene-ethyl acrylate copolymer, ethylene-vinyl acetate copolymer, and ethylene-butyl acrylate copolymer. Among them, polyethylene is most preferred.

The conductive filler may be selected from powder nickel, gold dust, powder copper, silvered powder copper, metal-alloy powder, carbon black, carbon powder or carbon graphite. Among them, carbon black is most preferred.

Figure 2:
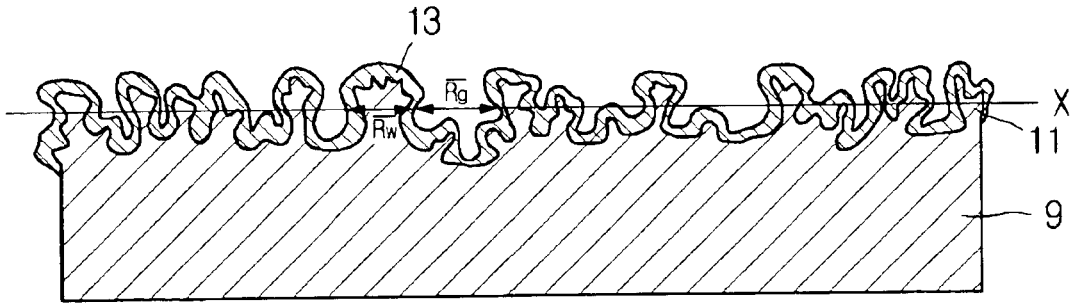
FIG. 2 is a sectional view showing an electrode applied to the device of FIG. 1.

In addition, as shown in FIG. 2, the metal electrode includes a base layer 9 made of a first metal, and a surface layer 13 made of a second metal and interposed between the base 9 and the conductive polymer 7 so as to be directly contacted with the conductive polymer. The first metal may be selected from copper, aluminum, zinc, nickel and the like, and copper is most preferred. In addition, the second metal has more excellent compatibility with the conductive polymer than the first metal, and acts as a diffusion barrier for preventing degradation of polymer due to contacting with the copper of the base layer. The second metal may be selected from nickel, zinc and the like, and nickel is most preferred.

In order to increase mechanical binding force with the conductive polymer, a plurality of protrusions 11 are formed on the surface of the base layer 9. Micro-roughness of such a base layer is produced by electrodeposition. In addition, the surface layer 13 of the present invention is formed on the surface of the base layer 9, on which a plurality of protrusions 11 are formed, with a uniform thickness by means of electrolytic plating or electroless plating. In particular, the nickel surface layer 13 is preferably produced using the electroless plating. The electroless nickel-plating includes a degreasing process, a pickling process, an actuating and sensitizing treatment, an electroless nickel-plating process and a rinsing process. The surface layer 13 of the present invention preferably has a thickness of 0.1 to 5 $\mu$m. As mentioned above, by plating nickel at a uniform thickness on the surface of the base layer having the protrusions, it is possible to prevent degradation of the conductive polymer or corrosion of the electrolytic copper, which are caused by direct contact between the conductive polymer and the base layer. As a result, it is also possible to improve chemical binding force with the conductive polymer 7 without deteriorating the surface roughness of the base layer 9. At this time, if the thickness of the surface layer 13 is not more than 0.1 $\mu$m, corrosion is not well prevented. On the while, if the thickness is not less than 5 $\mu$m, the surface roughness of the base layer 9 is deteriorated, which is apt to make a bad effect on the binding force.

Size of the protrusions 11 should be controlled intentionally. If the conductive polymer sheet 7 is thin, surface roughness Rz and an average width $\overline{Rw}$ of the protrusions 11 should be set to ensure sufficient mechanical binding force, not making the opposite protrusions not be contacted with each other so that a breakdown does not happen.

In the above configuration, the protrusion 11 is defined to include at least one ridge higher than ¾ of the surface roughness Rz, and be ranged from the lowest one among valleys positioned in one side of the valley and lower than ¼ of the surface roughness Rz to the lowest one among valleys positioned in the other side of the valley and lower than ¼ of the surface roughness Rz.

The protrusion 11 has a surface roughness Rz of 1 to 20 $\mu$m, and its average width $\overline{Rw}$ is preferably 0.5 to 2 times of the surface roughness Rz, more preferably 1 to 1.5 times thereof. In addition, the average width $\overline{Rw}$ is defined as the shortest distance between two points at which a center line X meets a curved surface of the protrusion, as shown in FIG. 2. The center line X is defined as a virtual line which is set so that sum of squares of the deviation of distance from a sectional curve of the surface layer 13 becomes minimized.

At this time, if the surface roughness Rz of the protrusions 11 is less than 1 $\mu$m, the protrusions are not sufficiently inserted into the conductive polymer, thereby deteriorating the binding force. If the surface roughness Rz is more than 20 $\mu$m, the protrusions faced with each other may be contacted, which is apt to cause a breakdown or air gap. In addition, if the average width $\overline{Rw}$ is less than 0.5 time of the surface roughness Rz, the protrusion is apt to be easily broken while the polymer is adhered to the metal electrode, while, if more than 2 times, the protrusion is not easily inserted into the polymer.

In addition, the protrusions formed on the surface of the metal electrode according to the present invention should be spaced apart from each other by regular gaps. For example, an average gap $\overline{Rg}$ between adjacent protrusions is preferably 0.5 to 2 times of the surface roughness Rz, more preferably 1 to 1.5 times of the surface roughness Rz.

Here, the average gap $\overline{Rg}$ is defined as the shortest distance between the nearest ones among points at which the curved surface of each protrusion meets the center line X.

If the average gap $\overline{Rg}$ according to the present invention is less than 0.5 time of the surface roughness Rz, air gap is generated while the polymer is adhered to the metal electrode. On the while, if more than 2 times, a supporting force by the protrusions is insufficient, thereby deteriorating the binding force between the polymer and the metal electrode.

In addition, along with the recent trends that electronic equipments become lighter, thinner, shorter and smaller, the conductive polymer sheet 7 should have a thickness suitable for expressing sufficient PTC characteristics without causing a breakdown. The conductive polymer sheet 7 according to the present invention suitably has a thickness more than 5 times of the surface roughness Rz of the protrusions.

Now, the present invention will be described in more detail with the following specific embodiments.

Embodiment 1

Polyethylene and carbon black (100 phr) are mixed to make a PTC conductive polymer sheet 50 $\mu$m thick, 5 mm wide and 10 mm long. An electrolytic copper foil on a surface of which a plurality of protrusions are formed by means of electrolytic plating is also prepared. In addition, an electroless nickel-plating layer 0.5 $\mu$m thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 $\mu$m, an average width $\overline{Rw}$ of 5 $\mu$m and an average gap $\overline{Rg}$ of 5 $\mu$m between adjacent protrusions. The electrodes are adhered to both sides of the PTC conductive polymer sheet in a sandwich type, thereby making the PTC electrical device as shown in FIG. 1.

Embodiment 2

Polyethylene and carbon black (100 phr) are mixed to make a PTC conductive polymer sheet 50 $\mu$m thick, 5 mm wide and 10 mm long. An electrolytic copper foil on a surface of which a plurality of protrusions are formed by means of electrolytic plating is also prepared. In addition, an electroless nickel-plating layer 1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 10 μm and an average gap $\overline{Rg}$ of 10 μm between adjacent protrusions. The electrodes are adhered to both sides of the PTC conductive polymer sheet in a sandwich type, thereby making the PTC electrical device as shown in FIG. 1.

Embodiment 3

Polyethylene and carbon black (100 phr) are mixed to make a PTC conductive polymer sheet 100 μm thick, 5 mm wide and 10 mm long. An electrolytic copper foil on a surface of which a plurality of protrusions are formed by means of electrolytic plating is also prepared. In addition, an electroless nickel-plating layer 5 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 20 μm and an average gap $\overline{Rg}$ of 20 μm between adjacent protrusions. The electrodes are adhered to both sides of the PTC conductive polymer sheet in a sandwich type, thereby making the PTC electrical device as shown in FIG. 1.

Embodiment 4

Polyethylene and carbon black (100 phr) are mixed to make a PTC conductive polymer sheet 100 μm thick, 5 mm wide and 10 mm long. An electrolytic copper foil on a surface of which a plurality of protrusions are formed by means of electrolytic plating is also prepared. In addition, an electroless nickel-plating layer 3 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 20 μm and an average gap $\overline{Rg}$ of 5 μm between adjacent protrusions. The electrodes are adhered to both sides of the PTC conductive polymer sheet in a sandwich type, thereby making the PTC electrical device as shown in FIG. 1.

Embodiment 5

Polyethylene and carbon black (100 phr) are mixed to make a PTC conductive polymer sheet 100 μm thick, 5 mm wide and 10 mm long. An electrolytic copper foil on a surface of which a plurality of protrusions are formed by means of electrolytic plating is also prepared. In addition, an electroless nickel-plating layer 0.5 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 5 μm and an average gap $\overline{Rg}$ of 20 μm between adjacent protrusions. The electrodes are adhered to both sides of the PTC conductive polymer sheet in a sandwich type, thereby making the PTC electrical device as shown in FIG. 1.

Embodiment 6

Polyethylene and carbon black (100 phr) are mixed to make a PTC conductive polymer sheet 100 μm thick, 5 mm wide and 10 mm long. An electrolytic copper foil on a surface of which a plurality of protrusions are formed by means of electrolytic plating is also prepared. In addition, an electroless nickel-plating layer 0.1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 1 μm, an average width $\overline{Rw}$ of 1 μm and an average gap $\overline{Rg}$ of 1 μm between adjacent protrusions. The electrodes are adhered to both sides of the PTC conductive polymer sheet in a sandwich type, thereby making the PTC electrical device as shown in FIG. 1.

Embodiment 7

Polyethylene and carbon black (100 phr) are mixed to make a PTC conductive polymer sheet 100 μm thick, 5 mm wide and 10 mm long. An electrolytic copper foil on a surface of which a plurality of protrusions are formed by means of electrolytic plating is also prepared. In addition, an electroless nickel-plating layer 5 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 20 μm, an average width $\overline{Rw}$ of 20 μm and an average gap $\overline{Rg}$ of 20 μm between adjacent protrusions. The electrodes are adhered to both sides of the PTC conductive polymer sheet in a sandwich type, thereby making the PTC electrical device as shown in FIG. 1.

COMPARATIVE EXAMPLE 1

Polyethylene and carbon black (100 phr) are mixed to make a PTC conductive polymer sheet 50 μm thick, 5 mm wide and 10 mm long. An electrolytic copper foil on a surface of which a plurality of protrusions are formed by means of electrolytic plating is also prepared. In addition, an electroless nickel-plating layer 1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 3 μm and an average gap $\overline{Rg}$ of 10 μm between adjacent protrusions. The electrodes are adhered to both sides of the PTC conductive polymer sheet in a sandwich type, thereby making the PTC electrical device as shown in FIG. 1.

COMPARATIVE EXAMPLE 2

Polyethylene and carbon black (100 phr) are mixed to make a PTC conductive polymer sheet 50 μm thick, 5 mm wide and 10 mm long. An electrolytic copper foil on a surface of which a plurality of protrusions are formed by means of electrolytic plating is also prepared. In addition, an electroless nickel-plating layer 1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 30 μm and an average gap $\overline{Rg}$ of 10 μm between adjacent protrusions. The electrodes are adhered to both sides of the PTC conductive polymer sheet in a sandwich type, thereby making the PTC electrical device as shown in FIG. 1.

COMPARATIVE EXAMPLE 3

Polyethylene and carbon black (100 phr) are mixed to make a PTC conductive polymer sheet 50 μm thick, 5 mm wide and 10 mm long. An electrolytic copper foil on a surface of which a plurality of protrusions are formed by means of electrolytic plating is also prepared. In addition, an electroless nickel-plating layer 1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 10 μm and an average gap $\overline{Rg}$ of 3 μm between adjacent protrusions. The electrodes are adhered to both sides of the PTC conductive polymer sheet in a sandwich type, thereby making the PTC electrical device as shown in FIG. 1.

COMPARATIVE EXAMPLE 4

Polyethylene and carbon black (100 phr) are mixed to make a PTC conductive polymer sheet 50 μm thick, 5 mm wide and 10 mm long. An electrolytic copper foil on a surface of which a plurality of protrusions are formed by means of electrolytic plating is also prepared. In addition, an electroless nickel-plating layer 1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 10 μm and an average gap $\overline{Rg}$ of 30 μm between adjacent protrusions. The electrodes are adhered to both sides of the PTC conductive polymer sheet in a sandwich type, thereby making the PTC electrical device as shown in FIG. 1.

COMPARATIVE EXAMPLE 5

Polyethylene and carbon black (100 phr) are mixed to make a PTC conductive polymer sheet 30 μm thick, 5 mm wide and 10 mm long. An electrolytic copper foil on a surface of which a plurality of protrusions are formed by means of electrolytic plating is also prepared. In addition, an electroless nickel-plating layer 1 μm thick is formed on the surface of the electrolytic copper foil through degreasing, pickling, actuating/sensitizing, electroless-nickel-plating and rinsing of the electrolytic copper foil, thereby making electrodes. At this time, the protrusions formed on the surface of the electrode have a surface roughness Rz of 10 μm, an average width $\overline{Rw}$ of 10 μm and an average gap $\overline{Rg}$ of 10 μm between adjacent protrusions. The electrodes are adhered to both sides of the PTC conductive polymer sheet in a sandwich type, thereby making the PTC electrical device as shown in FIG. 1.

EXPERIMENTAL EXAMPLE

The electrical devices manufactured according to the embodiments 1 to 7 and the comparative examples 1 to 5 are measured for (1) Peel Strength, (2) Resistance according to PTC conductive polymer thickness, (3) Breakdown Voltage according to PTC conductive polymer thickness, (4) Resistance after Humidity Aging Test according to PTC conductive polymer thickness, and (5) Resistance after Solder Heat Withstand Test according to PTC conductive polymer thickness, and measured results are shown in Table 1.

At this time, Peel Strength is obtained by measuring peak strength in separation in order to measure mechanical binding force between the conductive polymer sheet and the electrode. Resistance of PTC electrical device is increased or decreased according to the thickness of the conductive polymer sheet, so the measured resistance is divided by the thickness of the conductive polymer sheet in order to remove the dependence on the thickness of the conductive polymer sheet. In the measurement of Breakdown Voltage Test, the measured value is also divided by the thickness of the conductive polymer sheet to obtain a property value, and a rising rate of voltage is 10 V/min in the measurement. Humidity Aging Test is conducted for 10,000 hrs under the conditions of 85° C., 95% R.H, and Solder Heat Withstand Test is conducted for 10 seconds at 210° C., and after the tests, resistance is measured and then marked as a value divided by the thickness of the conductively polymer sheet.

TABLE 1

| | A(kgf) | B(mΩ/mm) | C(V/mm) | D(mΩ/mm) | E(mΩ/mm) |
|---|---|---|---|---|---|
| Embodiment 1 | 1.5 | 150 | 250 | 160 | 230 |
| Embodiment 2 | 1.6 | 140 | 270 | 140 | 210 |
| Embodiment 3 | 1.4 | 155 | 260 | 150 | 220 |
| Embodiment 4 | 1.4 | 155 | 270 | 160 | 230 |
| Embodiment 5 | 1.5 | 150 | 270 | 160 | 225 |
| Embodiment 6 | 1.4 | 160 | 310 | 150 | 250 |
| Embodiment 7 | 1.6 | 145 | 260 | 155 | 200 |
| Comparative Example 1 | 1.5 | 150 | 250 | 250 | 260 |
| Comparative Example 2 | 0.6 | 200 | 260 | 185 | 340 |
| Comparative Example 3 | 1.4 | 160 | 270 | 165 | 400 |
| Comparative Example 4 | 0.5 | 190 | 240 | 190 | 255 |
| Comparative Example 5 | 1.5 | 155 | 120 | 160 | 230 |

Here, A is peel strength (kgf), B is resistance/PTC conductive polymer thickness (mΩ/mm), C is Breakdown voltage/PTC conductive polymer thickness (V/mm), D is resistance after Humidity Aging Test/PTC conductive polymer thickness (mΩ/mm), and E is resistance after Solder Heat Withstand Test/PTC conductive polymer thickness (mΩ/mm).

As seen from Table 1, Comparative Examples 2 and 4 show very bad peel strength and relatively high resistivity at room temperature rather than the embodiments of the present invention. Comparative Example 5 shows lower breakdown voltage than the embodiments of the present invention. In addition, it is also found that Comparative Example 1 shows higher resistivity after Humidity Aging Test than the embodiments of the present invention, and Comparative Examples 2 and 3 show higher resistivity after Solder Heat Withstand Test than the embodiments of the present invention.

As mentioned above, the electrical device according to the present invention shows more excellent binding force between the conductive polymer and the metal electrode and lower interfacial resistance, is suitable for preventing corrosion and air gap, and does not generate a breakdown, compared with the devices of the comparative examples.

The electrical device having PTC conductive polymer according to the present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

APPLICABILITY TO THE INDUSTRY

The PTC electrical device according to the present invention is capable of improving a binding force between the conductive polymer and the metal electrode with a minimal thickness of the conductive polymer, together with effectively preventing the breakdown phenomenon. In addition, the PTC electrical device of the present invention may prevent air gap from being generated by irregularity on the electrode surface when the conductive polymer is adhered to the metal electrode, and may be provided with excellent mechanical and chemical binding capacities.

What is claimed is:

1. An electrical device including a PTC (Positive Temperature Coefficient) conductive polymer sheet, and first and second electrodes physically contacted with opposite surfaces of the conductive polymer sheet, wherein the first and second electrodes have a plurality of protrusions protruded from surfaces thereof, respectively, wherein the protrusions have an surface roughness (Rz) of 1 to 20 $\mu$m and an average width ($\overline{Rw}$) which is 0.5 to 2 times of the surface roughness (Rz), and an average gap ($\overline{Rg}$) between adjacent protrusions is 0.5 to 2 times of the surface roughness (Rz), wherein the first and second electrodes respectively include a base layer made of a first metal having a microrough surface, and a surface layer made of a second metal and plated on the base layer with a uniform thickness, wherein the second metal has relatively more excellent chemical binding force to the conductive polymer than the first metal, and wherein the conductive polymer sheet has a thickness which is more than 5 times of the surface roughness (Rz).

2. The electrical device according to claim 1, wherein the first metal is copper, and the second metal is nickel.

3. The electrical device according to claim 2, wherein the base layer having the microrough surface is formed by means of electrodeposition, and the surface layer is formed by means of electroless plating.

4. The electrical device according to claim 3, wherein the average width ($\overline{Rw}$) of the protrusions is 1 to 1.5 times of the surface roughness (Rz).

5. The electrical device according to claim 3, wherein the average gap ($\overline{Rg}$) of the protrusions is 1 to 1.5 times of the surface roughness (Rz).

6. The electrical device according to claim 3, wherein the surface layer has a thickness of 0.1 to 5 $\mu$m.

* * * * *